United States Patent [19]

Diery et al.

[11] 3,992,306

[45] Nov. 16, 1976

[54] METAL-WORKING AND CORROSION PROTECTION AGENT

[75] Inventors: Helmut Diery, Paris, France; Horst Fröhlich, Liederbach, Taunus, Germany; Rainer Helwerth, Frankfurt am Main, Germany; Horst Lorke, Oberliederbach, Taunus, Germany

[73] Assignee: Hoechst Aktiengesellschaft, Frankfurt am Main, Germany

[22] Filed: June 12, 1974

[21] Appl. No.: 478,525

[30] Foreign Application Priority Data

June 18, 1973 Germany ..... 2330978

[52] U.S. Cl. ..... 252/33.6; 72/42; 252/47.5; 252/49.3; 252/391

[51] Int. Cl.[2] ..... C10M 1/54

[58] Field of Search ..... 252/33.6, 47.5, 49.3, 252/391

[56] References Cited

UNITED STATES PATENTS

| | | | |
|---|---|---|---|
| 2,908,648 | 10/1959 | Spivack et al. | 252/47.5 |
| 3,027,405 | 3/1962 | Spivack et al. | 252/33.6 X |
| 3,556,994 | 1/1971 | Diery et al. | 252/33.6 |
| 3,788,991 | 1/1974 | Diery et al. | 252/33.6 |

*Primary Examiner*—Delbert E. Gantz
*Assistant Examiner*—Andrew H. Metz
*Attorney, Agent, or Firm*—Connolly and Hutz

[57] ABSTRACT

Aqueous metal working liquids containing a bis-sulfonamidocarboxylic acid of the formula

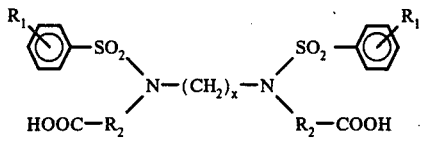

in the form of its water soluble or water dispersible salt with an alkali or an organic base, as corrosion protection and metal-working agent wherein $R_1$ denotes hydrogen, halogen, alkyl and/or alkoxy of 1 to 3 carbon atoms, $R_2$ denotes an alkylene radical having a total of 1 to 5 carbon atoms, and x denotes an integer of from 2 to 6.

3 Claims, No Drawings

METAL-WORKING AND CORROSION PROTECTION AGENT

The present invention relates to a metal working and corrosion protection agent.

It is known that salts of long-chain aliphatic sulfonamido-carboxylic acids have a corrosion-inhibiting effect and are used in the metal-working industry both for the machining of metals, in boring, turning, cutting, sawing, grinding and tread-cutting, and also for non-cutting shaping in drawing and rolling.

In accordance with their constitution, however, those compounds are oleophilic and are therefore used in emulsions, either by themselves or in combination with mineral oils, vegetable or animal oils. Emulsions of this nature, however, show a series of disadvantages both in practical manipulation and also in properties. Thus water of low hardness should as far as possible be used for the manufacture of such emulsions. Their composition has to be checked constantly since these emulsions easily break while separating one of their components. It is a further disadvantage that emulsions are opaque so that the article to be worked cannot be observed during the working process.

Attempts have for this reason been made to develop oil-free water-soluble metal working compositions having a corrosion protection effect. Known products of this type are compounds on the basis of long-chain alkyl- or alkylaryl-sulfonamidocarboxylic acids. Although these products do not have the disadvantages of emulsions, they still have some disadvantageous properties; for example, excessive foaming or adhesion on machines interfere in particular. Moreover, their corrosion protection action is inadequate for many purposes. Oil-free water-soluble metal working agents having corrosion protection action are also disclosed in the two German Auslegeschriften Pat. Nos. 2,297,798 and 1,298,672 and in German Offenlegungsschrift Pat. No. 1,771,584 to be compounds on the basis of short-chain alkylaryl- or alkyldiaryl-sulfonamidocarboxylic acids. Those products have a low tendency to foam and adhesion on machines and afford corrosion protection even in a low concentration.

It has now been found that alkali metal or amino salts of bis-sulfonamidocarboxylic acids of the general formula I

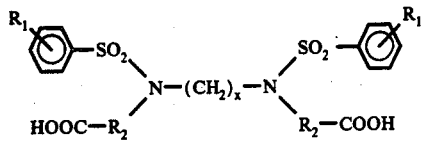

(I)

are suitable for use as metal working and corrosion protection agents having especially advantageous properties.

In formula I, $R_1$ stands for hydrogen, halogen, in particular chlorine or bromine, alkyl and/or alkoxy of 1 to 3 carbon atoms, $R_2$ stands for an alkylene group of up to a total of 1 to 5 carbon atoms, optionally having methyl groups as side chains, and $x$ stands for an integer of from 2 to 6.

These compounds differ from the known sulfonamidocarboxylic acids in that they have a diaminoalkane chain containing 2 to 6 methylene groups and having two sulfonyl and two carboxyl groups linked to their amide-nitrogen atoms. Moreover, they have an improved corrosion protection effect in an aqueous medium.

Possible bases for the formation of the salts with the above-mentioned bis-sulfonamidocarboxylic acids are any desired inorganic or organic bases to the extent that they lead to water-soluble products. Herein "water-soluble" is also to be understood to include the colloidal, emulsoid or suspensoid state. For the salt formation it is for example possible to use, inter alia, alkalis or preferably organic nitrogen bases such as monomethylamine, dimethylamine and trimethylamine, monoethylamine, diethylamine and triethylamine, monoisopropylamine, monobutylamine and dibutylamine, 3-methoxypropylamine, mono-2-ethylhexylamine, dimethylaminopropylamine, monoethanol-amine, diethanolamine and triethanolamine, 3-aminopropanol, monomethylethanolamine, dimethylethanolamine, monoisopropanolamine, triisopropanolamine, cyclohexylamine, N,N-dimethylcyclohexylamine, morpholine, pyridine, quinoline, ethylene diamine, diethylene triamine, pentaethylene hexamine or also amines, for example fatty amines which have been reacted with alkylene oxides having 2 to 4 carbon atoms. The trialkanolamine salts, especially the triethanolamine salts, are preferably used.

For the salt formation, the component may be employed in a stoichiometric ratio or also with either component in excess. The corrosion protection effect depends, above all, on the structure of the formula I, the type of the bases to be used for the salt formation has no decisive influence on the corrosion protection effect.

The metal working compositions of the invention may be used as such or in admixture with the known metal working fluids or aqueous oil emulsions. The compositions may be employed in aqueous solutions, dispersions, or emulsions.

As compounds of the formula (I) to be used according to the invention, there may be mentioned, for example: N,N'-dibenzene-sulfonyl-N,N'-bis-(carboxymethyl)-1,2-diaminoethane; N,N'-dibenzene sulfonyl-N,N'-bis-(β-carboxyethyl)-1,2-diaminoethane; N,N'-di-(p-chlorobenzene-sulfonyl)-N,N'-bis-(β-carboxyethyl)-1,2-diaminoethane, N,N'-di-(p-methylbenzene-sulfonyl)-N,N'-bis-(γ-carboxypropyl)-1,2-diaminoethane, N,N'-dibenzene-sulfonyl-N,N'-bis-(ε-carboxypentyl)-1,2-diaminoethane, N,N'-dibenzenesulfonyl-N,N'-bis-(β-carboxyethyl)-1,4-diaminobutane, N,N'-dibenzene-sulfonyl-N,N'-bis-(β-carboxyethyl)-1,6-diaminohexane.

The compounds of the invention are prepared according to known methods. According to a conventional method, α,ω-diaminoalkanes are first reacted with arylsulfochlorides in the presence of organic or inorganic bases, especially alkali metal hydroxides, at temperatures of from −20° to 100° C, preferably 5° to 50° C, according to the following reaction scheme:

$$NH_2-(CH_2)_x-NH_2 + 2\ (Ar-SO_2Cl) \rightarrow Ar-SO_2-NH-(CH_2)_x-NH-SO_2Ar$$

in which x has the meaning as defined above and Ar means an aryl, preferably the benzene radical, to yield N,N'-diarylsulfonyldiaminoalkanes.

The N,N'-diarylsulfonyldiaminoalkanes thus obtained are then reacted in an organic, preferably polar proton-free solvent, for example dimethylsulfoxide, in the presence of catalytic amounts of a strong base, for example an alkali metal hydroxide, at temperatures of from −20° to 150° C, preferably from 15° to 75° C, with esters, nitriles or alkali metal salts of carboxylic acids having 3 to 6 carbon atoms and a double bond in $\alpha,\beta$-position with regard to the nitrile group, where required the reaction products may finally be saponified in order to yield the free acids.

According to another method, the N,N'-diarylsulfonyldiamino-alkanes may be first converted into the dialkali metal salts in a proton-free organic solvent, for example dimethylsulfoxide, at temperatures of from 0° to 250° C, preferably from 50° to 180° C, with the aid of twice the molar amount of alkali metal alcoholates; after a treatment with $\beta$- or $\gamma$-lactones in the same temperature range, the dialkali metal salts finally afford the alkali metal salt of the acids of formula (I).

The N,N'-diarylsulfonyl-diamino-alkanes may finally also be reacted with esters, nitriles or alkali metal salts of halogenated carboxylic acids having 2 to 6 carbon atoms, in aqueous or organic solvents, preferably in aqueous-organic solvents, at temperatures of from 0° to 120° C, preferably from 50° to 100° C, in the presence of molar or excess amounts of alkalis, for example sodium hydroxide, to yield the corresponding derivatives of the bis-sulfonamidocarboxylic acids of the formula I, which may be converted into the free acids by saponification.

Yet another method for the preparation of the compounds of the formula (I) resides in the fact that, in a first step, N,N'-diamino-alkane-alkylene-carboxylic acids or esters, nitriles or alkali metal salts thereof are prepared and these are then reacted in known manner with arylsulfonyl chlorides, whereupon the compounds of the invention are obtained, where required after saponification. According to this method, $\gamma,\omega$-diamino-alkanes are first reacted with two mols (per mol of diamino-alkane) of an ester, nitrile or alkali metal salt of a carboxylic acid having 3 to 6 carbon atoms and a double bond in $\alpha,\beta$-position with regard to the carbonyl or nitrile group, according to the following reaction equation (the carboxylic acid component used being a carboxylic acid ester):

$$H_2N-(CH_2)_x-NH_2 + 2\ CH_2=CH-CO_2R \rightarrow RO_2C-CH_2-CH_2-NH-(CH_2)_x-NH-CH_2-CH_2-CO_2R$$

The N,N'-diamino-alkane alkylene carboxylic acids and the esters, nitriles or alkali metal salts thereof thus obtained may be used to prepare the compounds of the invention in known manner.

The metal working and corrosion protection compositions of the invention are distinguished by a good solubility in water and a good efficiency even when used in very low concentrations. Another substantial advantage of these compounds is their very high lubricating effect and their considerably reduced tendency to foam or adhesion on machines. The use concentration of the metal working agents of the invention is generally within the range of from about 0.1 to about 2 % by weight but these values may also be lower or higher.

The following Examples illustrate the invention.

EXAMPLE 1

N,N'-dibenzene-sulfonyl-N,N'-bis-($\beta$-carboxyethyl)-1,2-diaminoethane (Ar = $-C_6H_5$, R = $-CH_2-CH_2-$, $x = 2$)

60 Grams (1.0 mol) of 1,2-diaminoethane were dissolved in 500 ml of water, and at 20°–25° C, 370 g (2.1 mols) of benzene-sulfonyl chloride and simultaneously, to maintain a pH-value of 12, about 275 g of a 33 % sodium hydroxide solution were added dropwise within 1 hour. The mixture was then neutralized to pH 7, the precipitate was suction-filtered and the N,N'-dibenzene-sulfonyl-1,2-diaminoethane was washed with water and dried in vacuo at 75° C.

Yield: 332 g (97 % of the theoretical yield), m.p. 167°–168° C.

136 Grams (0.4 mol) of N,N'-dibenzene-sulfonyl-1,2-diaminoethane were dissolved in 250 ml of dimethylsulfoxide, 4 g of sodium methylate were added and 88 g (0.88 mol) of freshly distilled ethyl acrylate were added dropwise within 30 minutes at 20°–25° C. Stirring was continued for 1 hour at room temperature, the mixture was neutralized to pH 7 by means of concentrated hydrochloric acid and the solution was poured into 1 l of water. The precipitate was suction-filtered and washed with water. For saponification, the crude N,N'-dibenzene-sulfonyl-N,N'-bis-($\beta$-carboxyethyl)-1,2-diaminoethane was refluxed for 30 minutes in a mixture of 250 ml of ethanol and 250 ml of water with 32.5 g (0.88 mol) of sodium hydroxide; after cooling, it was diluted with 500 ml of water and acidified while cooling with concentrated hydrochloric acid. The product was suction-filtered, washed with water and dried in vacuo at 75° C.

Yield: 164 g (85 %), m.p. 188°–190° C. After recrystallization from ethanol, m.p. 204°–205° C.

N,N'-dibenzene-sulfonyl-1,2-diaminoethane could also be prepared in analogous manner by reaction with 0.88 mol of freshly distilled ethyl methacrylate.

In analogous manner, N,N'-di-(p-chlorobenzene-sulfonyl)-N,N'-bis-($\beta$-carboxyethyl)-1,2-diaminoethane, m.p. 224°–226° C; N,N'-di-(p-methylbenzene-sulfonyl)-N,N'-bis-($\beta$-carboxyethyl)-1,2-diaminoethane, m.p. 205°–207° C; N,N'-dibenzene-sulfonyl-N,N'-bis-($\beta$-carboxyethyl)-1,4-diaminobutane, m.p. 142°–145° C and N,N'-dibenzene-sulfonyl-N,N'-bis-($\beta$-carboxyethyl)-1,6-diaminohexane, m.p. 148°–150° C, were prepared.

EXAMPLE 2

N,N'-dibenzene-sulfonyl-N,N'-bis-($\gamma$-carboxypropyl)-1,2-diaminoethane (Ar = $-C_6H_5$, R = $-(CH_2)_3-$, $x = 2$)

34 Grams (0.1 mol) of N,N'-dibenzene-sulfonyl-1,2-diaminoethane (prepared as in Example 1) were dissolved in 200 ml of dimethylsulfoxide. At 120°–130° C, 10.8 g (0.2 mol) of sodium methylate were added and methanol was distilled off in a nitrogen stream, while the internal temperature was raised to 170° C. Within 20 minutes, 20.6 g (0.24 mol) of $\gamma$-butyrolactone were added dropwise to the suspension of the disodium compound, whereupon the precipitate dissolved. Stirring was continued for 2 hours in 170° C; after cooling, the mixture was poured into 500 ml of water, and a small amount of starting material was separated by filtration. The filtrate was acidified, the precipitate was suction-filtered, washed with water and dried in vacuo at 75° C. Yield: 39.2 g (76.5 %), m.p. 188°–198° C; after recrystallization from methanol-dimethylformamide (2:1), the compound had a melting point of 208°–209° C.

EXAMPLE 3

N,N'-dibenzene-sulfonyl-N,N'-bis-(carboxymethyl)-1,2-diaminoethane ($Ar = -C_6H_5$, $R = -CH_2-$, $x = 2$)

68 Grams (0.2 mol) of N,N'-dibenzene-sulfonyl-1,2-diaminoethane, 38 g (0.4 mol) of chloroacetic acid and 32 g (0.8 mol) of sodium hydroxide were refluxed for 5 hours in 250 ml of a mixture of equal parts of ethanol and dimethylsulfoxide. After cooling, the product was filtered off, the filtrate was acidified, the precipitate was suction-filtered and recrystallized from ethanol. Yield: 71 g (78 %), m.p. 205°–206° C.

In analogous manner, N,N'-dibenzene sulfonyl-N,N'-bis(ε-carboxypentyl)-1,2-diaminoethane was prepared, m.p. 164°–166° C.

The afore-mentioned acids are converted into the corresponding salt with excess amine.

Even when used in a low concentration, the salts of the acids of formula (I) in an aqueous medium exhibit an excellent corrosion protection effect. Owing to their low use concentration, they differ advantageously from known commercial products.

The following Table indicates the concentrations of the acids corresponding to formula (I) in mol per liter of spring water (22°dH (German hardness), corresponding to 220 mg of CaO/l) and softened water (E water of about 3° German hardness, corresponding to 30 mg of CaO/l), at which the corrosion protection is still perfect (limit concentration).

The test methods used are the so-called Herbert test, disclosed in "IP Standards for Petroleum and its products", IP 125/63, using steel filings on a grey cast iron plate, and the modification of this test method using grey cast-iron filings (GG 22) on steel plates (Citroen test).

The following products were tested:

Compound 1 (comparative substance)
The triethanolammonium salt of N-benzenesulfonyl-N-methyl-ε-amino-n-caproic acid Compound 2
The triethanolammonium salt of N,N'-dibenzene-sulfonyl-N,N'-bis-(β-carboxyethyl)-1,2-diaminoethane Compound 3
The triethanolammonium salt of N,N'-dibenzenesulfonyl-N,N'-bis-(γ-carboxypropyl)-1,2-diaminoethane Compound 4
The triethanolammonium salt of N,N'-dibenzenesulfonyl-N,N'-bis-(ε-carboxypentyl)-1,2-diaminoethane Compound 5
The triethanolammonium salt of N,N'-dibenzenesulfonyl-N,N'-bis-(β-carboxyethyl)-1,4-diaminobutane Compound 6
The triethanolammonium salt of N,N'-dibenzenesulfonyl-N,N'-bis-(γ-carboxyethyl)-1,6-diaminohexane Compound 7
The triethanolammonium salt of N,N'-di-(p-methylbenzenesulfonyl)-N,N'-bis-(β-carboxyethyl)-1,2-diaminoethane Compound 8
The triethanol ammonium salt of N,N'-di-(p-chlorobenzenesulfonyl)-N,N'-bis-(β-carboxyethyl)-1,2-diaminoethane Compound 9
The triisopropanolammonium salt of N,N'-dibenzenesulfonyl-N,N'-bis-(β-carboxyethyl)-1,2-diaminoethane and Compound 10
The triisopropanolammonium salt of N,N'-dibenzenesulfonyl-N,N'-bis-(β-carboxyethyl)-1,6-diaminohexane.

TABLE 1

| Compound No. | Corrosion protection effect Limit concentration . $10^3$ Herbert test spring water 22° dH [mol/l] | Herbert test E water 3° dH [mol/l] | Citroen test spring water 22° dH [mol/l] | Citroen test E water 3° dH [mol/l] |
|---|---|---|---|---|
| 1 | 6.15 | 12.30 | 18.40 | 24.60 |
| 2 | 3.61 | 15.34 | 7.24 | 14.48 |
| 3 | 3.42 | 13.68 | 13.68 | 20.52 |
| 4 | 3.08 | 9.24 | 6.16 | 12.32 |
| 5 | 3.42 | 3.42 | 6.48 | 13.68 |
| 6 | 3.24 | 3.24 | 6.48 | 12.96 |
| 7 | 3.42 | 6.84 | 10.26 | 10.26 |
| 8 | 3.17 | 6.33 | 9.50 | 12.66 |
| 9 | 3.61 | 7.24 | 14.48 | 14.48 |
| 10 | 3.24 | 6.48 | 9.72 | 12.96 |

We claim:

1. An aqueous metal working solution characterized by 0.1 to 2 percent by weight content of a bis-sulfonamidocarboxylic acid of the formula I

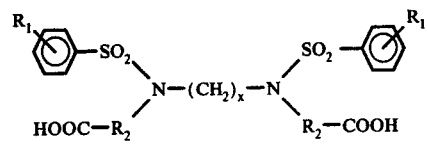

(I)

in the form of its water soluble or water dispersible salt with an alkali metal or a cyclic or acyclic alkylamine or alkanolamine base, as corrosion protection and metal-working agent, wherein $R_1$ may be the same or different and denotes hydrogen, halogen, alkyl or alkoxy of 1 to 3 carbon atoms, $R_2$ denotes an alkylene radical having a total of 1 to 5 carbon atoms, and $x$ denotes an integer of from 2 to 6.

2. An aqueous metal working liquid as claimed in claim 1 which contains the triethanol ammonium salt of a bis-sulfonamidocarboxylic acid of formula II

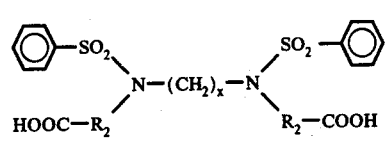

(II)

in which $R_2$ and $x$ have the meanings given in claim 1.

3. An aqueous metal working liquid as claimed in claim 1 which is N,N'-dibenzenesulfonyl-N,N'-bis(β-carboxyethyl)-diaminoethane.

* * * * *